United States Patent [19]

Uranishi et al.

[11] Patent Number: 5,027,780

[45] Date of Patent: Jul. 2, 1991

[54] AIR-FUEL CONTROL DEVICE FOR AN INTERNAL COMBUSTION ENGINE

[75] Inventors: Kouji Uranishi, Susono; Takaaki Itou, Mishima, both of Japan

[73] Assignee: Toyota Jidosha Kabushiki Kaisha, Aichi, Japan

[21] Appl. No.: 311,654

[22] Filed: Feb. 15, 1989

[30] Foreign Application Priority Data

Feb. 18, 1988 [JP] Japan ..... 63-34043

[51] Int. Cl.[5] ..... F02M 37/04

[52] U.S. Cl. ..... 123/520; 123/516

[58] Field of Search ..... 123/569, 568, 576, 520, 123/521; 137/587, 588

[56] References Cited

U.S. PATENT DOCUMENTS

| | | | |
|---|---|---|---|
| 3,884,204 | 5/1975 | Krautwurst et al. . | |
| 4,377,142 | 3/1983 | Otsuka | 123/520 |
| 4,467,769 | 8/1984 | Matsumura . | |
| 4,467,769 | 8/1984 | Masomura | 123/520 |
| 4,641,623 | 2/1987 | Hamburg | 123/518 |
| 4,646,702 | 3/1987 | Matsubara | 123/520 |
| 4,658,797 | 4/1987 | Brand | 123/520 |
| 4,683,861 | 8/1987 | Breitkreuz | 123/520 |
| 4,809,667 | 3/1989 | Uranishi et al. . | |
| 4,817,576 | 4/1989 | Abe | 123/519 |
| 4,838,229 | 6/1989 | Uranishi et al. . | |
| 4,841,940 | 6/1989 | Uranishi et al. . | |
| 4,887,578 | 12/1989 | Woodlock | 123/519 |

FOREIGN PATENT DOCUMENTS

| | | |
|---|---|---|
| 57-95457 | 6/1982 | Japan . |
| 62-131962 | 6/1987 | Japan . . |

*Primary Examiner*—Carl Stuart Miller

*Attorney, Agent, or Firm*—Kenyon & Kenyon

[57] ABSTRACT

An air-fuel ratio control device for an internal combustion engine, the device comprising a unit for detecting a first fuel purge condition from the canister after the fuel tank is filled with fuel, and for reducing the amount of fuel to be supplied to the engine when the first fuel purge condition is detected.

21 Claims, 8 Drawing Sheets

AIR-FUEL CONTROL DEVICE FOR AN INTERNAL COMBUSTION ENGINE

BACKGROUND OF THE INVENTION

1. Field of the Invention

The present invention relates to an air-fuel ratio control device for an internal combustion engine having a canister for absorbing fuel vapor in the fuel tank of a vehicle.

2. Description of the Related Art

In an internal combustion engine, it is known to provide a canister for absorbing fuel vapor in a fuel tank, and after absorption, to allow the fuel in the canister to be purged to the engine in accordance with the engine operating conditions. The purge of fuel from the canister to the engine, however, makes the air-fuel ratio unexpectedly richer, and thus interrelated the purging control and fuel supply control must be carried out.

For example, Japanese Unexamined Patent Publication No. 62-131962 discloses an internal combustion engine having a canister, purge control means, and an oxygen sensor for a feedback control of the air-fuel ratio. In this publication, during the purge time, a 10 percent purge flow control is first carried out while learning a variation in the correction factor of the air-fuel ratio and estimating changes in the correction factor of the air-fuel ratio at a 100 percent purge flow control, and subsequently, the 100 percent purge flow control is carried out simultaneously with a feedback control of the air-fuel ratio using the value estimated for the 100 percent purge.

U.S. Pat. No. 3884204 discloses a fuel vapor control device in which, when the fuel tank is being filled with fuel, a seal is established between the inlet opening of the fuel tank and the filler nozzle and the fuel tank is connected to the canister via a pipe, to prevent fuel vapor from escaping to the atmosphere during the filling of the fuel tank.

Japanese Patent Application No. 61-255745, filed by the same assignee for the present case, discloses an internal combustion engine in which fuel vapor generated during the filling of the fuel tank is absorbed in the canister, and a restriction and a solenoid valve are arranged in parallel in the purge passage between the fuel tank and the canister. The solenoid valve is closed when the engine is first started after the filling of the fuel tank, to allow the fuel to be gradually purged through the restriction, and the solenoid valve is opened after a predetermined time to allow large quantities of the fuel to be purged.

In the above systems, however, the following problems arise. A large quantity of the fuel vapor is generated during the filling of the fuel tank with fuel, so that the air-fuel ratio during the purge just after the filling tends to become very much richer. Also, the rate of purging of the fuel, i.e., the rate of release of the fuel vapor from the canister, has a peak at the initial stage of the purging and decreases with the elapse of time, even when the opening of the purge flow control valve is maintained at a constant value.

In the technique disclosed in the above-described Japanese Unexamined Patent Publication No. 62-131962, no special consideration is given to the fuel vapor generated during the filling of the fuel tank, so that the 10 percent purge flow control is always carried out at the initial stage of each purge, to learn variations of the correction factor of the air-fuel ratio. Therefore, at the initial stage of the purge after filling the fuel tank, the fuel purge flow is restricted by partially closing the purge flow control valve, but the actual fuel purge flow is high, for the above reasons, and thus the air-fuel ratio becomes very rich, with the result that control delays occur and the drivability is deteriorated even after the air-fuel ratio is brought to the lean side.

In the technique in the above Japanese Application, fuel is gradually purged through the restriction by closing the solenoid valve, to prevent an overrich air-fuel ratio at the initial stage of the purge. Nevertheless, the air-fuel ratio becomes overrich and the drivability is deteriorated. To overcome this problem, the cross sectional area of the restriction must be made very small, but this means that a long time is needed to complete the purging of the fuel from the canister. Further, since the canister has a restricted absorption capacity, the fuel must be purged when the fuel is already absorbed thereon and the absorbing capacity recovered as soon as possible for the next absorption cycle. Therefore if long time is needed to complete the purging of fuel from the canister, the absorption capacity for absorbing the subsequently generated fuel vapor is reduced.

Further, in the above described arts, parallel passages or an additional valve must be provided for controlling the fuel purge flow step by step, from a large quantity to a small quantity, resulting in a complicated purging arrangement.

SUMMARY OF THE INVENTION

The object of the present invention is to provide an air-fuel ratio control device of an internal combustion engine without a complicated purging arrangement.

Therefore, according to the present invention, there is provided an air-fuel ratio control device for an internal combustion engine having a fuel tank, a fuel supply means for supplying fuel from the fuel tank to the engine, a canister having a means for absorbing fuel vapor in the fuel tank, and a purge control means allowing the fuel contained in the canister to be purged to the engine. According to the present invention, the air-fuel ratio control device comprise a first detecting means for detecting a filling of the fuel tank with fuel, a second detecting means for detecting a fuel purge condition from the canister to the engine, and a control means for detecting a first fuel purge condition from the canister after a filling of the fuel tank, from the outputs of the first and second detecting means, and for detecting the amount of fuel to be supplied when the first purging condition is detected.

With this arrangement, fuel absorbed during the filling of the fuel tank and contained in the canister can be fully purged without escaping to the atmosphere and the canister is recovered so that the subsequent absorption capacity is not restricted, by only changing the fuel supply without providing a complicated purging arrangement, whereby fuel economy and small variations of the air-fuel ratio are obtained.

BRIEF EXPLANATION OF THE DRAWINGS

The present invention will be described in more detail with reference to the preferred embodiments of the invention with reference to the accompanying drawings, in which.

DESCRIPTION OF THE PREFERRED EMBODIMENTS

Figure 1:
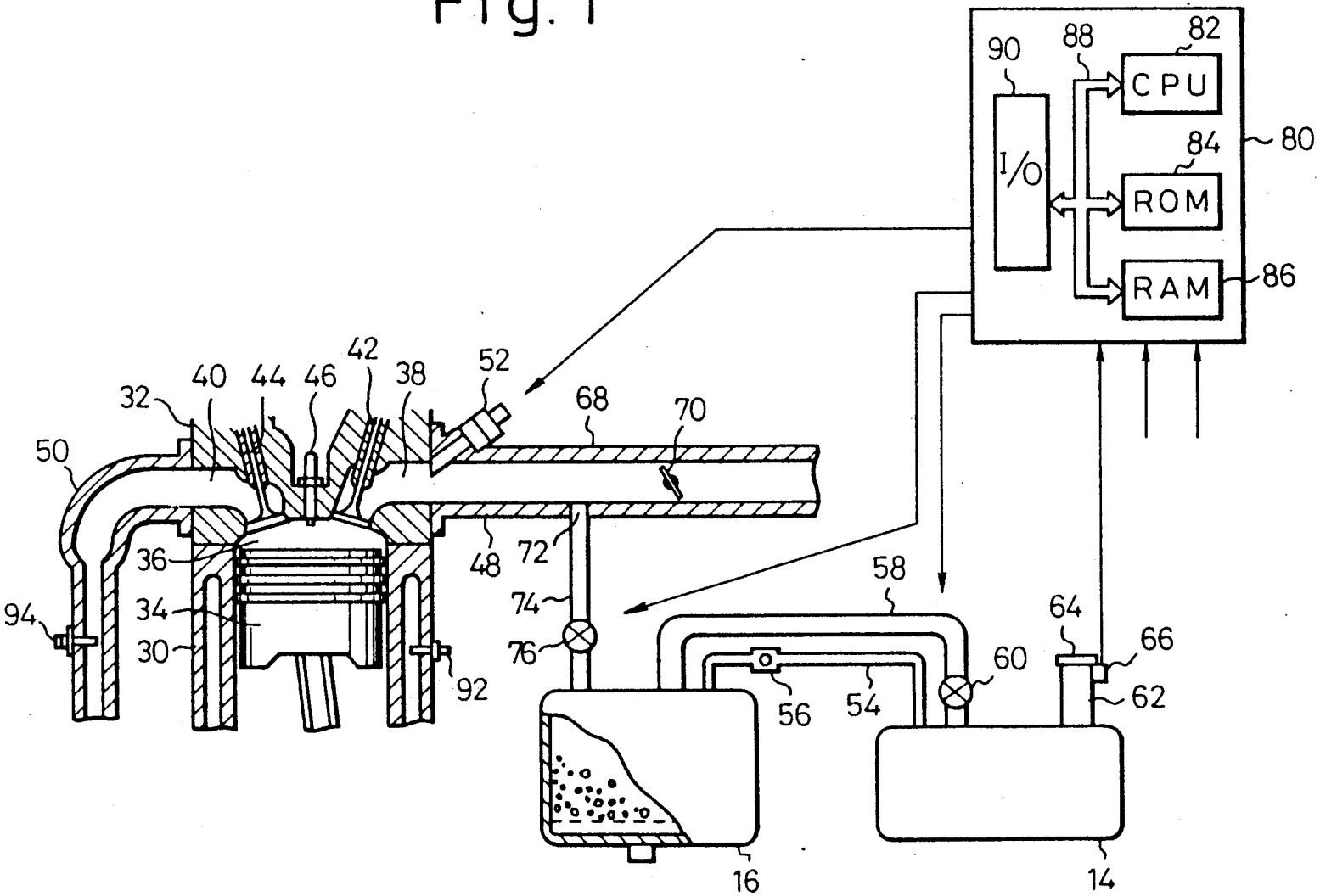
FIG. 1 is a schematic view of an internal combustion engine of the preferred embodiments of the present invention.

Referring to FIG. 1, the internal combustion engine comprises a cylinder block 30, a cylinder head 32, a piston 34 reciprocally moving in the cylinder bore, and a combustion chamber 36 formed above the piston 34. An intake port 38 and an exhaust port 40 are formed in the cylinder head 32, and an intake valve 42 and an exhaust valve 44 are arranged in these ports, respectively. Also, an ignition plug 46 is provided in the center of the combustion chamber 36. An intake manifold 48 and an exhaust manifold 50 are attached to the cylinder head 32.

A fuel injector 52 is provided in each of the branch pipes of the intake manifold 48 or in the intake port 38. The fuel injector 52 comprises a solenoid valve of a known structure, receives fuel from a fuel tank 14 through a fuel feed pump (not shown), and injects fuel by opening the valve in correspondence with the control signal. It is well known that the amount of the fuel to be injected corresponds to the time of opening of the fuel injector 52. The piping connecting the fuel tank 14 to the fuel injector 52 is omitted in the drawings.

A canister 16 contains a well known means for absorbing fuel vapor, such as activated charcoal. An evaporator pipe 54 connects the top region of the fuel tank 14 to the inlet of the canister 16 and a check valve 56 is arranged in the evaporator pipe 54. The check valve 56 allows a flow of fuel vapor generated in the fuel tank 14 toward the canister 16 and maintains the pressure in the fuel tank 14 at a constant value, regardless of the temperature or the amount of fuel in the fuel tank 14.

A vapor recovery pipe 58 similarly connects the top region of the fuel tank 14 to the inlet of the canister 16, and a filling solenoid valve 60 is arranged in the vapor recovery pipe 58 or at the top of the fuel tank 14. As is known, the fuel tank 14 has an inlet neck 62 and a cap 64 at the upper end of the inlet neck 62. The inlet neck 62 is constructed such that a filler nozzle (not shown) can be inserted after removing the cap 64 and a seal established between the inlet neck 62 and the filler nozzle to prevent fuel vapor from escaping to the atmosphere during the filling of the fuel tank. Also, a filling detecting switch 66 is provided in cooperation with the cap 64. The filling detecting switch 66 can be provided on the inlet neck 62, as shown, or can be provided on the body of the automobile at an appropriate position, cooperating with a means for access to the fuel tank 14. The filling solenoid valve 60 operates in response to the output of the filling detecting switch 66, whereby the filling solenoid valve 60 is opened to allow fuel vapor generated during the filling of the fuel tank 14 to be absorbed in the canister 16 when the cap 64 is opened. The filling solenoid valve 60 is closed when the cap 64 is closed.

The intake manifold 48 is further connected to an intake pipe 68 having a throttle valve 70 arranged therein. A purge port 72 is provided in the intake pipe 68 downstream of the throttle valve 70 and a purge pipe 74 connects this purge port 72 to the outlet of the canister 16. A purge control solenoid valve 76 is arranged in the purge pipe 74.

The fuel injector 52, the filling solenoid valve 60, and the purge control solenoid valve 76 are controlled by an electronic control device 80, which is constituted as an microcomputer system and comprises a central processing unit (CPU) 82 having arithmetic and control functions, a read only memory (ROM) 84 storing the program, and a random access memory (RAM) 86 storing data, these components being interconnected and connected to an input/output (I/O) port 90 by a bus 88. It is known to use various sensors for control of the fuel injection in the internal combustion engine. For example, an air flow sensor (not shown) for detecting the flow of the intake air as representing the load of the engine, a revolution sensor (not shown) for detecting the revolution of the engine, a throttle position sensor (not shown), a temperature sensor 92 for detecting the temperature of the engine cooling water, and an oxygen sensor 94 mounted on the exhaust manifold 50. These sensors are well known and a detailed description thereof omitted. According to the present invention, the filling detecting switch 66 is an additional sensor.

Figure 2:
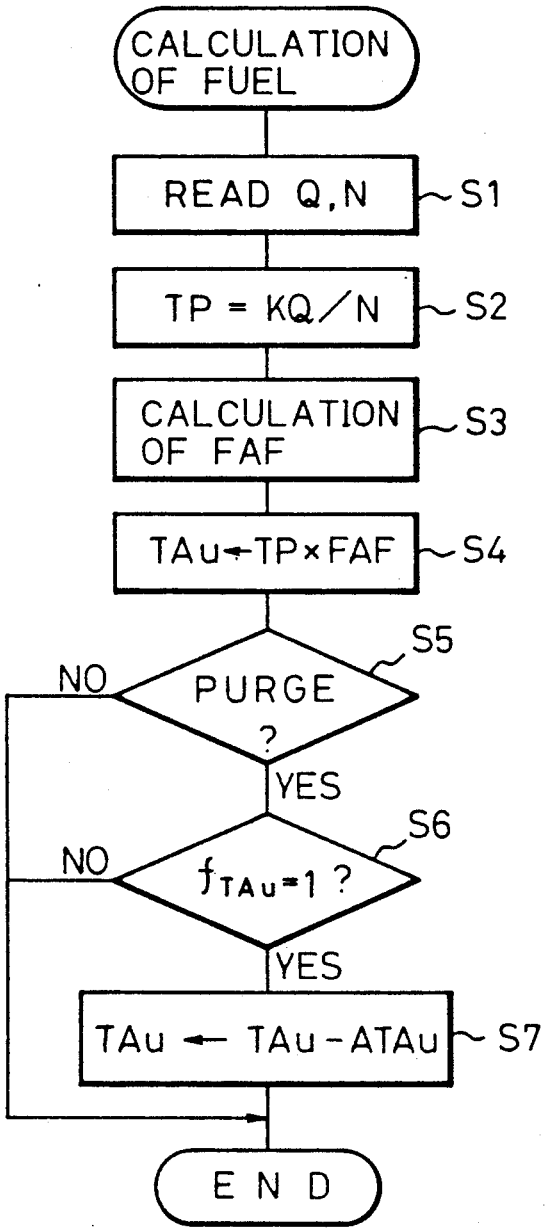
FIG. 2 is a flow chart of fuel calculations according to the present invention.

FIG. 2 is a flow chart for calculating the amount of fuel in an embodiment of the present invention. The amount of fuel is generally calculated by multiplying the fundamental fuel value used to provide a theoretical air-fuel ratio by correction factors depending on the engine operating conditions. In the present invention also, the flow of intake air (Q) and the revolution (N) of the engine as outputs from the above sensors are read at step 1 (S1) and the fundamental fuel value (TP) is calculated at step 2, by the relationship $TP=K\times(Q/N)$. It is possible to multiply the fundamental fuel value by correction factors (for example, a starting correction, a cold temperature correction, an acceleration correction, and so on), as described above, but such corrections are omitted here to simplify the description.

At step 3, the feedback correction factor FAF is calculated. This calculation is based on the output of the oxygen sensor 94, by increasing or the decreasing a minute value around the center 1.0. Then at step 4, the amount of the fuel to be injected TAu is calculated, by the relationship $TAu=TP\times FAF$. It will be clear to a person having an ordinary skill in the art that, when the feedback correction factor FAF is greater than 1.0 the air-fuel ratio as detected by the oxygen sensor 94 is too lean, and thus the amount of the fuel to be injected must be increased. Conversely, when the feedback correction factor FAF is lower than 1.0, the air-fuel ratio as detected by the oxygen sensor 94 is too rich, and thus the amount of the fuel to be injected must be decreased.

According to the present invention, the calculated amount of the fuel to be injected TAu is further corrected. Namely, at step 5, it is determined whether or not the purging condition is satisfied. If the result is YES, the program goes to step 6 and it is determined whether or not the flag $f_{TAU}$ is set to 1. The flag $f_{TAU}$ shows that it is necessary to reduce the amount of fuel during the first purge after the filling of the fuel tank 14. If the result is YES at step 6, the program goes to step 7 and the reduced fuel value ATAu is subtracted from the amount of the fuel to be injected TAu by the relationship TAu=TAu−ATAu. If the result is NO at step 5 or 6, the amount of the fuel to be injected TAu is maintained as calculated at step 4. The fuel injection is carried out by opening the fuel injector 52 at timings relative to the crank angle, and the injecting time corresponds to the amount of the fuel to be injected TAu.

Figure 3:
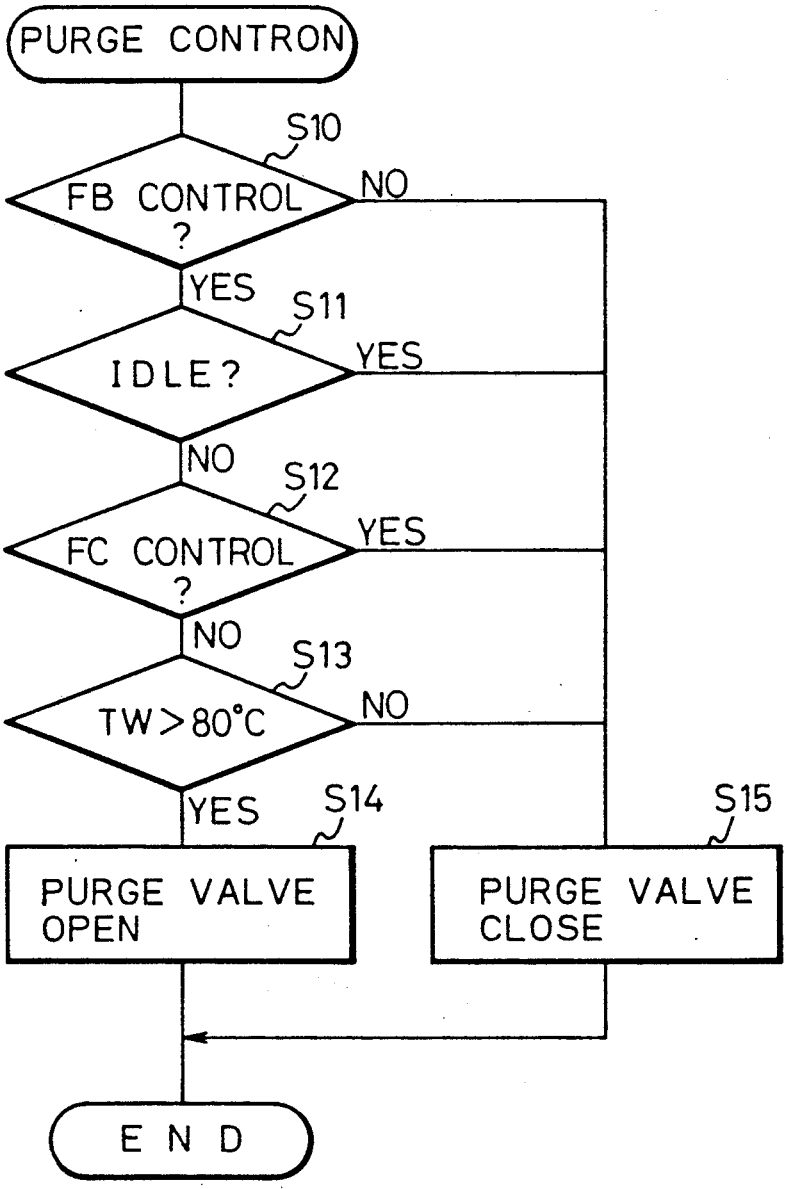
FIG. 3 is a flow chart of a purge control according to the present invention, constituting the base of the purge judgement step in FIG. 2.
Figure 4:
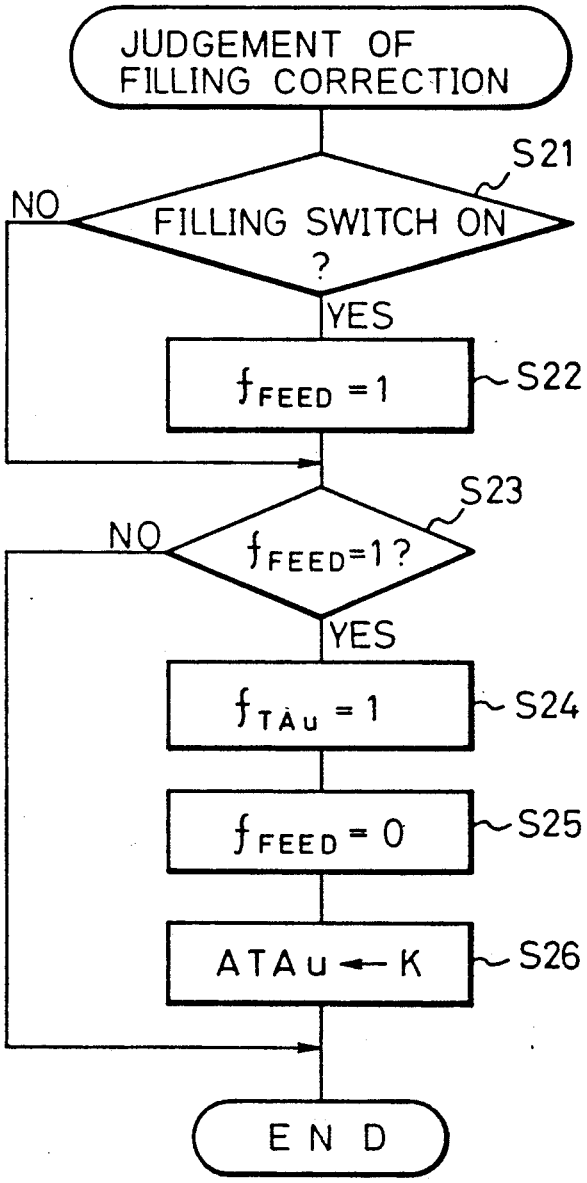
FIG. 4 is a flow chart of the judgement of a filling correction including detection of a filling of the fuel tank and a calculation of the reduced fuel value, used in FIG. 2.
Figure 5:
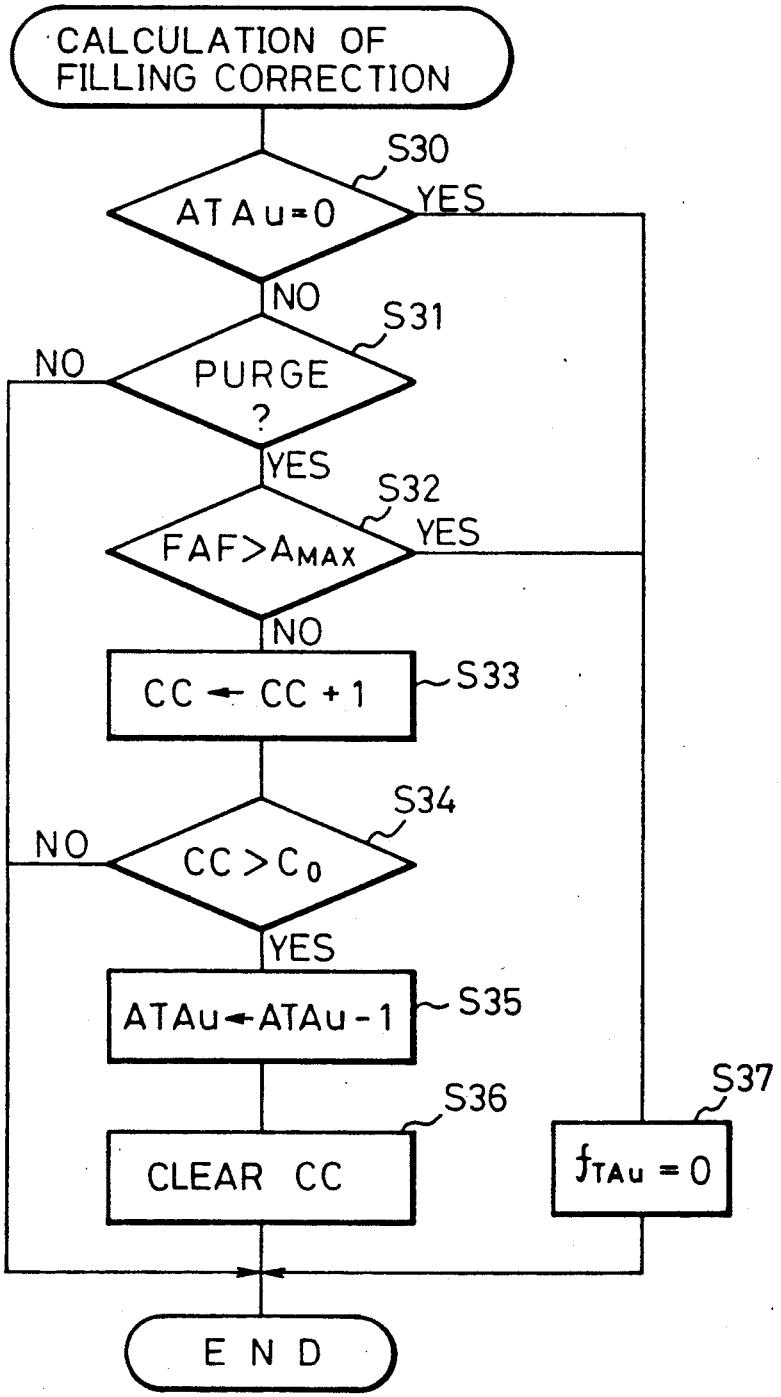
FIG. 5 is a flow chart of the calculation of a filling correction including a stepwise calculation of the reduced fuel value.

FIG. 3 shows an example of a purge control which constitutes the base of the purging judgement of step 5 in FIG. 2; FIG. 4 illustrates the setting of the flag $f_{TAU}$ of step 6 requiring a reduction of the amount of fuel during the first purge after the filling of the tank 14; and FIG. 5 illustrates the calculation of the reduced fuel value ATAu.

Referring to FIG. 3, at step 10, it is determined whether or not the feedback control condition is satisfied. The feedback control is prohibited when the above described corrections depending on the engine operating conditions, for example, a starting correction, a cold temperature correction, an acceleration correction and so on, are carried out. Namely, the feedback control is carried out when the above described corrections are not carried out. If the result is YES at step 10, the program goes to step 11 and it is determined whether or not the engine is idling. If the result is NO at step 11, the program goes to step 12 and it is determined whether or not a fuel cut is being carried out. Then, if the result is NO at step 12, the program goes to step 13 and it is determined whether or not the temperature of the engine cooling water TW is higher than 80° C. Note, the temperature of the engine cooling water TW is one of the engine operating parameters used for the feedback control, but in this case, the feedback control is carried out when the temperature of the engine cooling water TW is higher than 60° C. Thus, the reference value of the temperature of the engine cooling water TW for the purging judgement is higher than that for the feedback control.

If the result is YES at step 13, the program goes to step 14 and the purge control solenoid valve 76 is opened. If the result is reversed at each of the above described steps 10 to 13, the program goes to step 15 and the purge control solenoid valve 76 is closed. Therefore, it is possible to determine the purge at step 5 in FIG. 2 by determining the opening conditions of the purge control solenoid valve 76. Note, the control of the purge control solenoid valve 76 is carried out regardless of the filling of the fuel tank 14, and the amount of the fuel to be injected TAu is calculated at step 4 in FIG. 2 regardless of the purging. According to the present invention, the fuel is reduced only when the conditions at both steps 5 and 6 are satisfied.

Referring to FIG. 4, at step 21, it is determined whether or not the filling detecting switch 66 is switched ON. In the engine, the program is usually finished by switching the ignition switch OFF, and is maintained in the finished state when the fuel tank 14 is filled. According to the present invention, it is possible to start the program by switching the filling detecting switch 66 ON. Then if the result is YES at step 21, the program goes to step 22 and the flag $f_{FEED}$ indicating a filling of the fuel tank 14 is set to 1. The program may be once ended when the filling detecting switch 66 is switched OFF, and storing the data of the flag $f_{FEED}$ in the backup RAM while the ignition switch is switched OFF. Thereafter, the program is restarted when the ignition switch is switched ON, and proceeds from step 21 to step 23. At step 23, it is determined whether or not the flag $f_{FEED}$ is set to 1. If the result is NO at step 23, it is judged that there is no filling of the fuel tank 14 and this routine is completed. If the result at step 23 is YES, the program goes to step 24 and the flag $f_{TAU}$ requiring a reduction of the amount of fuel during the first purge after the filling of the fuel tank 14, is set to 1. Then at step 25, the flag $f_{FEED}$ is rest to 0, and at step 26, the reduced fuel value ATAu is set by a constant value K.

Referring next to FIG. 5, at step 30, it is determined whether or not the reduced fuel value ATAu is 0. If the result is YES at step 30, the program goes to step 37 and the flag $f_{TAU}$ requiring a reduction of the amount of fuel during the first purge after the filling of the fuel tank 14, is reset to 0. Therefore, the program does not go through steps 6 and 7 in FIG. 2, and the fuel amount is not reduced even when a purge is carried out. If the result is NO at step 30, the program goes to step 31 and it is determined whether the purge condition is satisfied. This routine ends if the result is NO, and the program goes to step 32 only when the result is YES at step 31. At step 32, it is determined whether or not the feedback correction factor FAF is greater than a predetermined maximum limit $A_{MAX}$.

Figure 6:
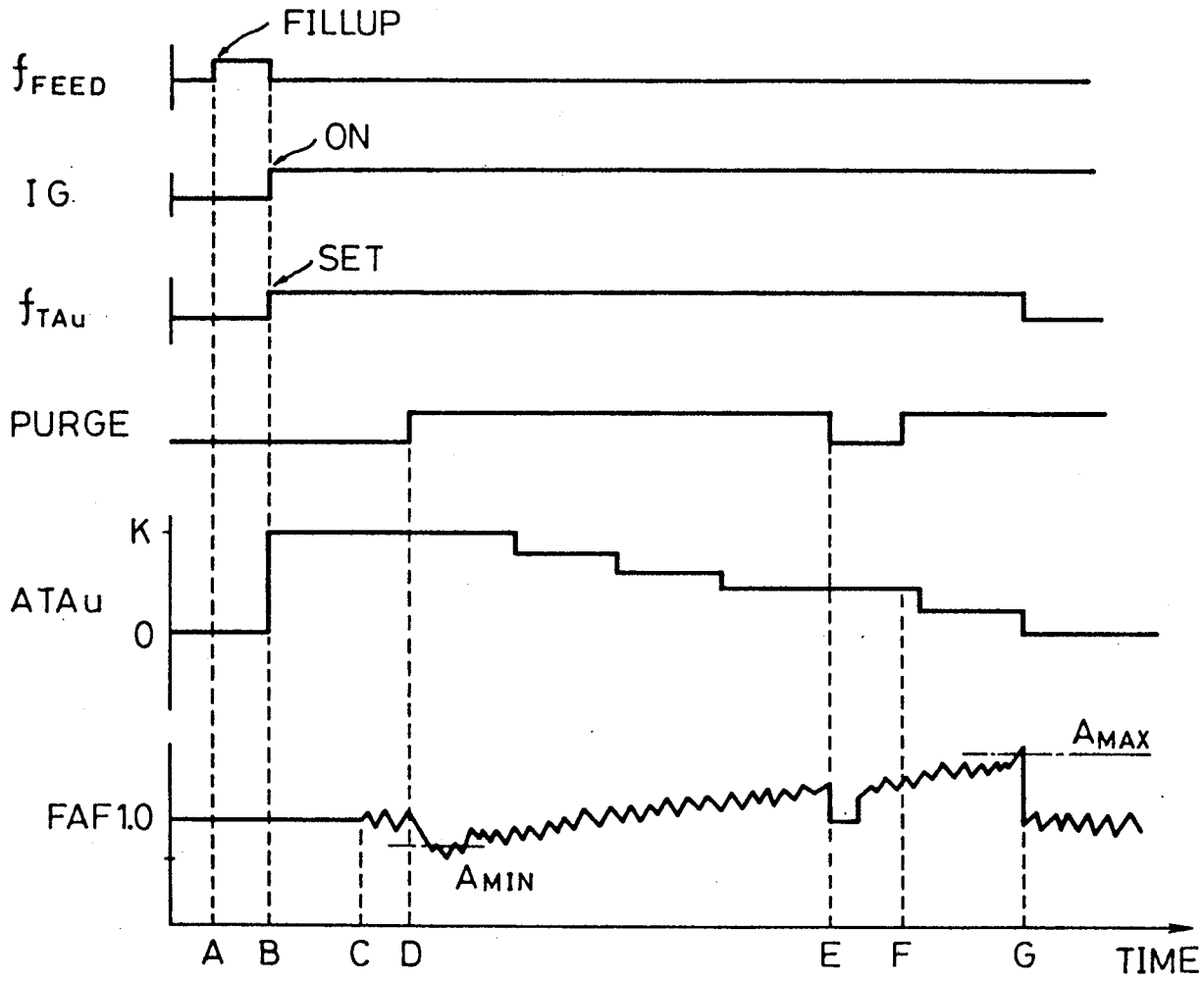
FIG. 6 is a timing chart for illustrating the operation of the various means shown in FIGS. 2 to 5 in relation to a common time axis.

Here, reference is made first to FIG. 6, which shows a timing chart of the operation of various components in relation to a common time axis. At a point A, the fuel tank 14 is filled and the flag $f_{FEED}$ is set to 1, as previously described. Then at a point B, the ignition switch (IG) is switched ON and the engine is started. At that moment, the flag $f_{TAU}$ is set to 1 and the flag $f_{FEED}$ is reset to 0, as explained at steps 24 and 25 in FIG. 4. Simultaneously, the reduced fuel value ATAu is set by a constant value K. If the flag $f_{TAU}$ is set to 1, the reduction of fuel is carried out in accordance with FIG. 2 when the purge condition is detected. The purge condition is detected at a point D.

As will be understood, the purge condition is in a narrower engine operating range than the feedback prohibiting condition (FIG. 3), and therefore, the feedback control is started at a point C, prior to the start of the purge. The feedback correction factor FAF is calculated by increasing or decreasing a minute value around the center 1.0, and varies in a saw tooth manner, as shown at the bottom of FIG. 6. Usually, a maximum limit $A_{MAX}$ and a minimum limit $A_{MIN}$ are provided to guard the feedback correction factor FAF. In this example, the maximum limit $A_{MAX}$ is used during the purge but the minimum limit $A_{MIN}$ is not used. The feedback correction factor FAF starts from 1.0 (C) and varies around 1.0 with a minute increase or decrease (CD). When the purging starts at point D, the feedback correction factor FAF is suddenly changed to a smaller value (air-fuel ratio is made richer). If the fuel is reduced when the flag $f_{TAU}$ is set to 1, the feedback correction factor FAF will gradually change to a higher value (air-fuel ratio is made leaner) and will reach to the maximum limit $A_{MAX}$, for example, at a point G in FIG. 6. This is the meaning of the judgement of step 32 in FIG. 5. The program will go to step 37 if the result is YES at step 32, and the reduction of the fuel amount stopped.

Referring again to FIG. 5, if the result is NO at step 32, the program goes to step 33 and a counter (or a timer) CC is set to count up one by one. Then the program goes to step 34 and it is determined whether the counter CC is greater than a predetermined value $C_0$. If the result is NO at step 34, the program goes to step 35 and the reduced fuel value ATAu is subtracted by one (or another number). Then at step 36, the counter CC is cleared. Thus the program passes through step 35 periodically at every cycles $C_0$ (or every time) to subtract one from the reduced fuel value ATAu. This stepwise decrease of the reduced fuel value ATAu is shown in FIG. 6. This decrease calculation is interrupted if the purging is not carried out; for example, this decrease calculation is interrupted during the periods between B and D, and between E and F, in which the reduced value ATAu is maintained at the same value for a long time in comparison to the other cycles. This feature is embodied by step 31. That is, the counter CC is not counted up and the reduced fuel value ATAu is not decreased if the result is NO at step 31.

Figures 7, 8:
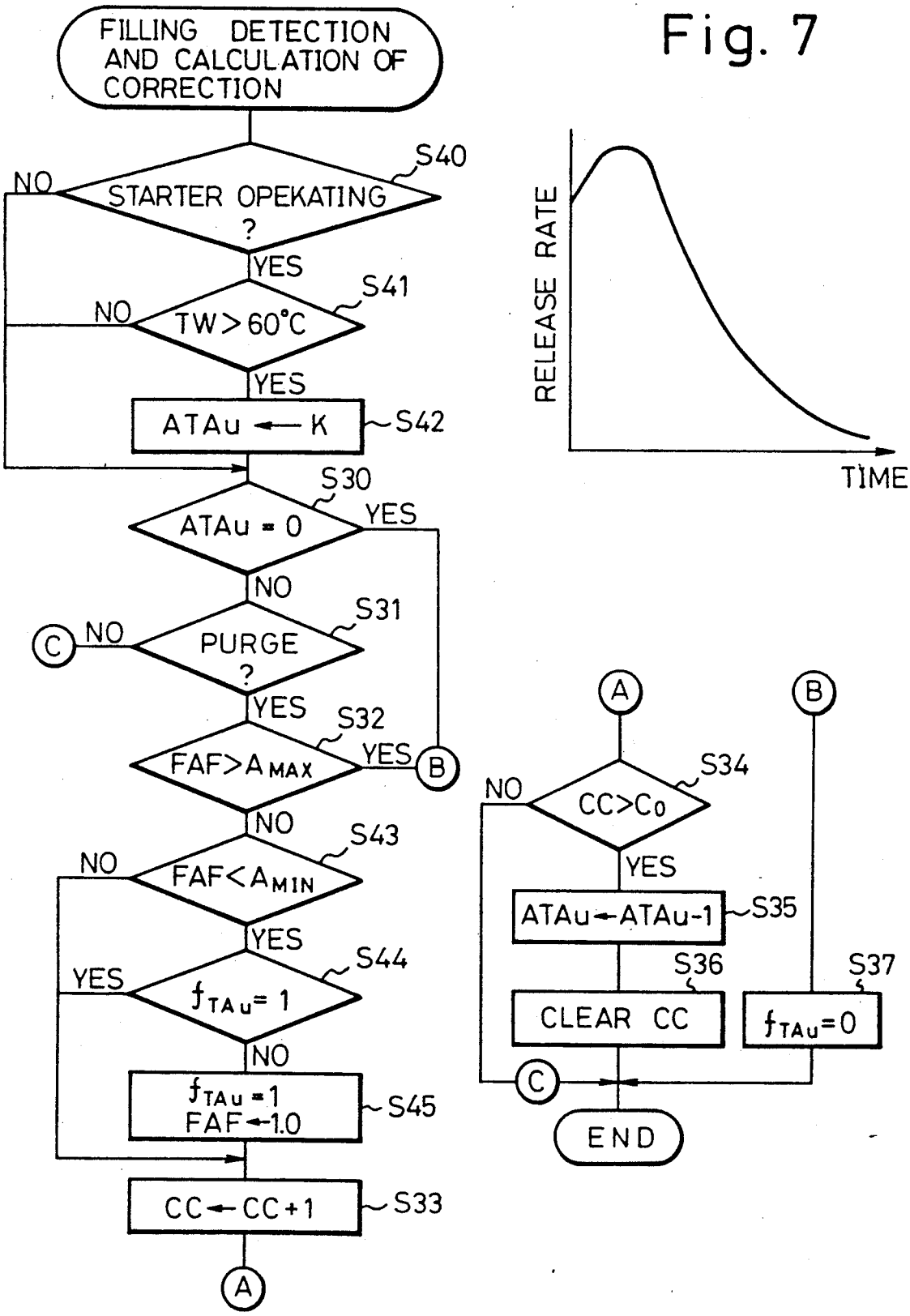
FIG. 7 is a graph of the fuel release rate from the canister.
FIG. 8 is a flow chart of filling detection and a calculation of a fuel correction according to the second embodiment of the present invention, similar to steps in FIGS. 4 and 5.

FIG. 7 shows a characteristic of a release of the once absorbed fuel from the canister 16 during the purge. As will be understood from FIG. 7, the fuel release rate is high during an initial stage of the purge and is gradually decreased with an elapse of time.

As described, the reduced fuel value ATAu is set by a constant value K at step 26 in FIG. 4. This constant value K is used first at step 35 in FIG. 5, and is the maximum of the reduced fuel value ATAu from which subtraction is made through the steps in FIG. 5. In this manner, the decrease of the reduced fuel value ATAu corresponds to the change of the fuel release rate from the canister 16 with an elapse of time, as described in reference to FIG. 7, so that the amount of the fuel to be injected TAu, defined at step 7 in FIG. 2, is decreased at once to a great extent to prevent the air-fuel ratio from becoming overrich during the initial intense purge stage, and then gradually decreased to adapt to the slow purge. If the result of step 32 in FIG. 5 becomes YES, in which the feedback correction factor FAF has reached the maximum limit $A_{MAX}$, the reduction of fuel ends even if the reduced fuel value ATAu c is not decreased to 0. In this way, it is possible to purge the fuel from the canister 16 in the shortest time while maintaining the smallest variation of the air-fuel ratio.

Figure 9:
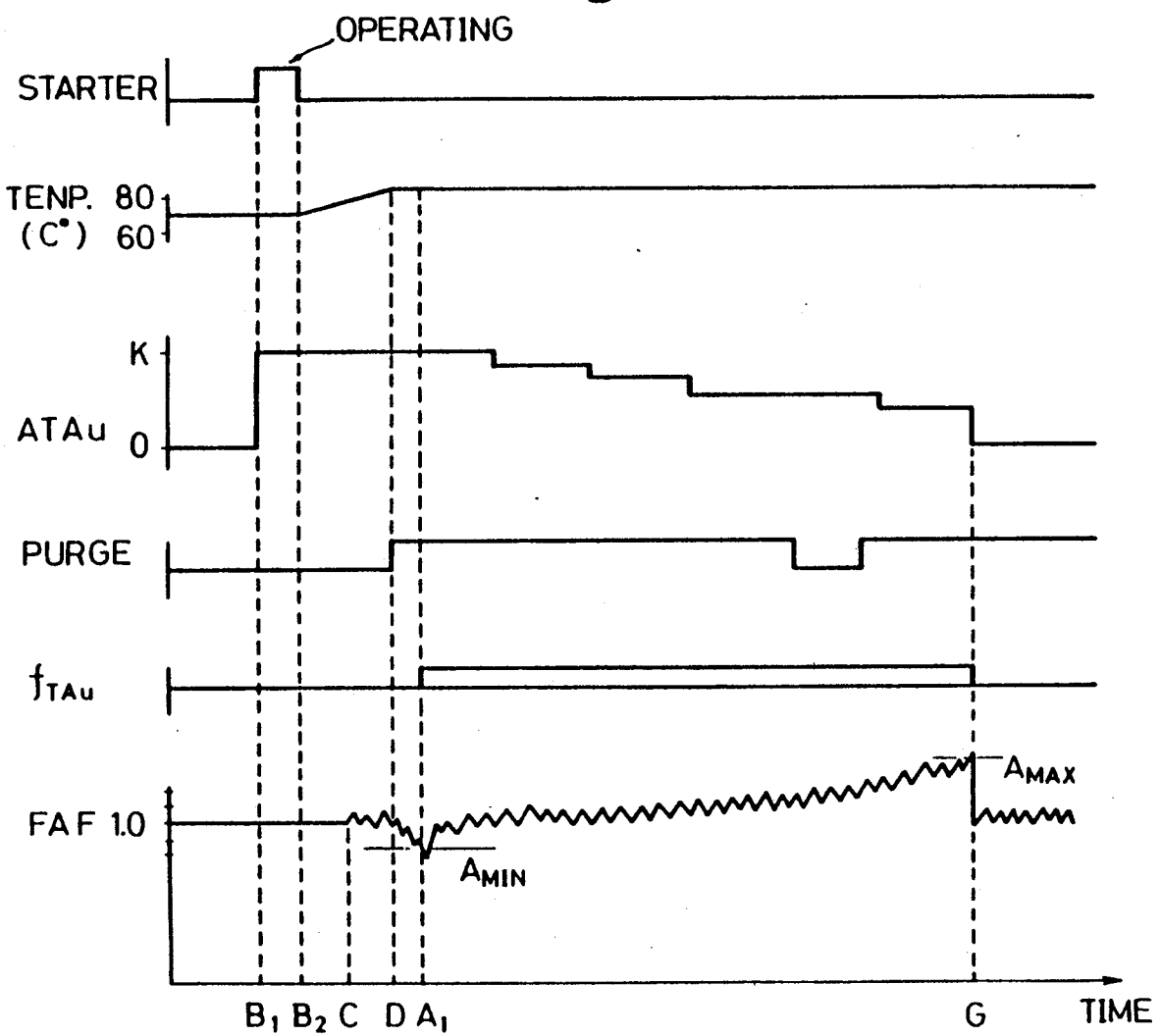
FIG. 9 is a timing chart illustrating the operation of FIG. 8, and is similar to FIG. 6.

FIG. 8 is the flow chart of the second embodiment according to the present invention. In FIG. 8, many portions are similar to the flow chart of FIG. 5, and identical portions are given the same reference numerals (S30 to S37). In FIG. 8, steps 40 to 42 occur before step 30, and steps 43 to 45 come between steps 32 and 33. Steps 40 to 45 have similar functions to those of the steps in FIG. 4. In FIG. 8, the filling detecting switch 66 is not used, but instead, the filling of the fuel tank 14 is detected by the feedback correction factor FAF. FIG. 9 illustrates the operation of the components in FIG. 8, similar to FIG. 6.

In FIG. 8, at step 40, it is determined whether the starter of the engine is operating. The starter is usually operated for several seconds when starting the engine (points $B_1$ and $B_2$ in FIG. 9). If the result is YES at step 40, the program goes to step 41 and it is determined whether the temperature of the engine cooling water TW is higher than 60° C. As in the previous embodiment, there are two reference values of the temperature of the engine cooling water TW; 80° C. for the purging control and 60° C. for the feedback control. The temperature (TEMP) is also shown in FIG. 9. In this embodiment, steps 40 and 41 constitute a part of the detecting means for detecting the filling of the fuel tank 14, detecting a possible filling of the fuel tank 14 by a judgement of the start of the engine at a temperature higher than the predetermined value, from an assumption of the restart of the engine after a short stop (at a service station) after the automobile has once run. Thus at step 42, the reduced fuel value ATAu is set to a constant value K, similar to that at step 26 in FIG. 4. If the result is NO at each of steps 40 and 41, the program goes direct to step 30.

At steps 30 to 32, it is determined whether the reduced fuel value ATAu is 0, whether the purging condition is satisfied, and whether the feedback correction factor FAF is greater than a predetermined maximum limit $A_{MAX}$ (lean), respectively, similar to FIG. 5. Then at step 43, it is determined whether the feedback correction factor FAF is smaller than a predetermined minimum limit $A_{MIN}$. As will be clear from FIG. 9, considering the parameter of the temperature, the feedback control is started first at a point C, and then (or simultaneously) the purge is started at a point D when the temperature becomes 80° C. It would be natural in this situation to consider that there is no cooling correction when increasing the fuel amount and to assume that usually the air-fuel ratio will not become overrich. Therefore, it is possible to detect a first purge after the filling of the fuel tank 14 when the feedback correction factor FAF is smaller than a predetermined minimum limit $A_{MIN}$. If the result is YES at step 43, the program goes to step 44 and it is determined whether the flag $f_{TAU}$ requiring a reduction of the amount of fuel during the first purge after the filling of the fuel tank 14 is set to 1. The flag $f_{TAU}$ is initialized to 0. Thus the program goes to step 45 and the flag $f_{TAU}$ is set to 1, and the feedback correction factor FAF is corrected to 1.0. The program goes from step 44 to step 45 at the first cycle, but from the next cycle, jumps from step 45 to step 33 to calculate the reduced fuel value ATAu, as explained previously in greater detail. In this manner, the flag $f_{TAU}$ and the reduced fuel value ATAu are set, and thus it is possible to calculate the amount of fuel to be injected TAu in accordance with the steps in FIG. 2. Although the reduction of the amount of fuel is carried out by subtracting the reduced fuel value ATAu from the amount of fuel to be injected TAu (after the feedback correction) in the illustrated embodiments, it is possible to reduce the fuel amount directly from the fundamental fuel value (before the feedback correction) according to the present invention.

We claim:

1. Am air-fuel ratio control device for an internal combustion engine having a fuel tank, a fuel supply means for supplying fuel from said fuel tank to said engine, a canister having means for absorbing fuel vapor in said fuel tank, and purge control means allowing fuel contained in said canister to be purged to said engine, said control device comprising:

first detecting means for detecting a filling of said fuel tank with fuel, said first detecting means comprising means for detecting the temperature of said engine when said engine is started and means for detecting the air-fuel ratio;

second detecting means for detecting a fuel purge condition from said canister to said engine; and control means for detecting a first fuel purge condition from said canister after a filling of said fuel tank from the outputs of said first and second detecting means and for reducing the amount of fuel to be supplied when the first purge condition is detected.

2. Am air-fuel ratio control device for an internal combustion engine having a fuel tank, a fuel supply means for supplying fuel from said fuel tank to said engine, a canister having means for absorbing fuel vapor in said fuel tank, and purge control means allowing fuel contained in said canister to be purged to said engine, said control device comprising:

first detecting means for detecting a filling of said fuel tank with fuel, said first detecting means comprising a switch cooperating with means for access to said fuel tank;

second detecting means for detecting a fuel purge condition from said canister to said engine; and control means for detecting a first fuel purge condition from said canister after a filling of said fuel tank from the outputs of said first and second detecting means and for reducing the amount of fuel to be supplied when the first purge condition is detected.

3. An air-fuel ratio control device for an internal combustion engine having a fuel tank, a fuel supply means for supplying fuel from said fuel tank to said engine, a canister having means for absorbing fuel vapor in said fuel tank, and purge control means allowing the fuel contained in said canister to be purged to said engine, said control device comprising:

first detecting means for detecting a filling of said fuel tank with fuel;

second detecting means for detecting a fuel purge condition from said canister to said engine;

third detecting means for detecting a first fuel purge condition from said canister after a filling of said fuel tank, from the outputs of said first and second detecting means; and calculating means for calculating the amount of the fuel to be supplied in response to the engine operating conditions, said calculating means including first calculating means for calculating the amount of fuel in accordance with a first predetermined way of calculation, second calculating means for calculating a reduced value of the amount of fuel in accordance with a second predetermined way of calculation, and third calculating means for subtracting said reduced value from the amount of fuel calculated by said first calculating means, whereby fuel is supplied at the subtracted value when the first purge condition is detected and supplied by the nonsubtracted value calculated by said first calculating means when the first purge condition is not detected.

4. An air-fuel ratio control device for an internal combustion engine having a fuel tank, a fuel supply means for supplying fuel from said fuel tank to said engine, a canister having means for absorbing fuel vapor in said fuel tank, and purge control means allowing fuel contained in said canister to be purged to said engine, said control device comprising:

first detecting means for detecting a filling of said fuel tank with fuel including means for detecting the temperature of said engine when said engine is started and means for detecting the air-fuel ratio;

second detecting means for detecting a fuel purge condition from said canister to said engine; and control means for detecting a first fuel purge condition from said canister after a filling of said fuel tank from the outputs of said first and second detecting means and for reducing the amount of fuel to be supplied when said first fuel purge condition is detected, said first fuel purge condition being detected when said engine is started at a temperature greater than a predetermined value and an air-fuel ratio is smaller than a predetermined value.

5. An air-fuel ratio control device for an internal combustion engine having a fuel tank, a fuel supply means for supplying fuel from said fuel tank to said engine, a canister having means for absorbing fuel vapor in said fuel tank, and purge control means allowing fuel contained in said canister to be purged to said engine, said control device comprising:

first detecting means for detecting a filling of said fuel tank with fuel;

second detecting means for detecting a fuel purge condition from said canister to said engine; and control means for detecting a first fuel purge condition from said canister after a filling of said fuel tank from the outputs of said first and second detecting means and for reducing the amount of fuel to be supplied when the first purge condition is detected, the amount of fuel being reduced first by a predetermined value when the first fuel purge condition is detected and then the reduced value being gradually minimized.

6. An air-fuel ratio control device according to claim 2, wherein said means for access to said fuel tank comprises an inlet cap of said fuel tank.

7. An air-fuel ratio control device according to claim 2, wherein said purge control means includes a purge control valve arranged in a line connecting said canister to said engine, and said second detecting means detects an open condition of said purge control valve.

8. An air-fuel ratio control device according to claim 2, wherein the amount of fuel is reduced first by a predetermined value when the first fuel purge condition is detected and then the reduced value is gradually minimized.

9. An air-fuel ratio control device according to claim 8, wherein the reduction of the amount of fuel is started when the first fuel purge condition is detected and continued within a predetermined time.

10. An air-fuel ratio control device according to claim 8, wherein the reduction of the amount of fuel is started when the first fuel purge condition is detected and continued until the air-fuel ratio reaches a predetermined leaner limit.

11. An air-fuel ratio control device according to claim 3, wherein said first detecting means comprises a switch cooperating with means for access to said fuel tank.

12. An air-fuel ratio control device according to claim 11, wherein said means for access to said fuel tank comprises an inlet cap of said fuel tank.

13. An air-fuel ratio control device according to claim 3, wherein said purge control means includes a purge control valve arranged in a line connecting said canister to said engine, and said second detecting means detects an open condition of said purge control valve.

14. An air-fuel ratio control device according to claim 3, wherein said first detecting means comprises means for detecting the temperature of said engine when said engine is started and means for detecting the air-fuel ratio, said first fuel purge condition being detected when said engine is started at a temperature greater than a predetermined value and an air-fuel ratio is smaller than a predetermined value.

15. An air-fuel ratio control device according to claim 3, wherein the amount of fuel is reduced first by a predetermined value when the first fuel purge condition is detected and then the reduced value is gradually minimized.

16. An air-fuel ratio control device according to claim 15, wherein the reduction of the amount of fuel is started when the first fuel purge condition is detected and continued within a predetermined time.

17. An air-fuel ratio control device according to claim 15, wherein the reduction of the amount of fuel is started when the first fuel purge condition is detected and continued until the air-fuel ratio reaches a predetermined leaner limit.

18. An air-fuel ratio control device according to claim 4, wherein said purge control means includes a purge control valve arranged in a line connecting said canister to said engine, and said second detecting means detects an open condition of said purge control valve.

19. An air-fuel ratio control device according to claim 5, wherein said purge control means includes a purge control valve arranged in a line connecting said canister to said engine, and said second detecting means detects an open condition of said purge control valve.

20. An air-fuel ratio control device according to claim 5, wherein the reduction of the amount of fuel is started when the first fuel purge-condition is detected and continued within a predetermined time.

21. An air-fuel ratio control device according to claim 5, wherein the reduction of the amount of fuel is started when the first fuel purge condition is detected and continued until the air-fuel ratio reaches a predetermined leaner limit.

* * * * *

UNITED STATES PATENT AND TRADEMARK OFFICE

CERTIFICATE OF CORRECTION

PATENT NO. : 5,027,780

DATED : July 2, 1991

INVENTOR(S) : Kouji Uranishi, et. al.

It is certified that error appears in the above-indentified patent and that said Letters Patent is hereby corrected as shown below:

Column 2, line 43, change "comprise" to --comprises--.
Column 3, line 4, change "base" to --basis--.
Column 4, line 21, change "an" to --a--.
Column 4, line 17, change "rest" to --set--.
Column 8, line 57, change "Am" to --An--.
Column 9, line 9, change 'Am" to --An--.

Signed and Sealed this

Sixth Day of July, 1993

Michael K. Kirk

*Attest:*

MICHAEL K. KIRK

*Attesting Officer*

*Acting Commissioner of Patents and Trademarks*